US008033068B2

(12) United States Patent
Lüttmann et al.

(10) Patent No.: US 8,033,068 B2
(45) Date of Patent: Oct. 11, 2011

(54) MOBILE PARTITIONING WALL

(75) Inventors: Olaf Lüttmann, Bad Zwischenahn (DE); Harald Hoopmann, Westerstede (DE)

(73) Assignee: Dorma GmbH + Co. KG, Ennepetal (DE)

( * ) Notice: Subject to any disclaimer, the term of this patent is extended or adjusted under 35 U.S.C. 154(b) by 557 days.

(21) Appl. No.: 12/083,166

(22) PCT Filed: Sep. 12, 2006

(86) PCT No.: PCT/EP2006/008855

§ 371 (c)(1),
(2), (4) Date: Apr. 7, 2008

(87) PCT Pub. No.: WO2007/039045

PCT Pub. Date: Apr. 12, 2007

(65) Prior Publication Data

US 2009/0113799 A1 May 7, 2009

(30) Foreign Application Priority Data

Oct. 6, 2005 (DE) ..... 10 2005 048 157

(51) Int. Cl.
*E04H 14/00* (2006.01)

(52) U.S. Cl. ..... 52/243.1; 52/64; 52/238.1; 52/782.1; 49/316; 49/317; 49/319; 49/320; 49/321; 160/40

(58) Field of Classification Search ..... 52/782.1, 52/783.1, 784.14, 793.1, 794.1, 796.1, 309.9, 52/309.14, 238.1, 274, 283, 481.1, 578, 239, 52/243.1, 64; 49/358, 316, 317, 319, 320, 321; 160/40, 135, 351
See application file for complete search history.

(56) References Cited

U.S. PATENT DOCUMENTS

| | | | | |
|---|---|---|---|---|
| 3,049,195 | A | 8/1962 | James et al. | |
| 3,072,975 | A * | 1/1963 | Burmeister | 49/317 |
| 3,110,131 | A | 11/1963 | Thomas | |
| 3,295,257 | A * | 1/1967 | Douglass | 49/317 |
| 3,309,916 | A | 3/1967 | Pearson | |
| 3,335,532 | A | 8/1967 | Greenbie | |
| 3,341,992 | A | 9/1967 | Piper | |
| 3,387,418 | A | 6/1968 | Tyrer | |

(Continued)

FOREIGN PATENT DOCUMENTS

AT 324 638 9/1975

(Continued)

OTHER PUBLICATIONS

Search Report dated Dec. 28, 2006 issued for the underlying International PCT Application No. PCT/EP2006/008855.

(Continued)

*Primary Examiner* — Brian Glessner
*Assistant Examiner* — James Buckle, Jr.
(74) *Attorney, Agent, or Firm* — Cozen O'Connor

(57) ABSTRACT

Mobile partitioning wall with several wall elements displaceably suspended in running rails. The mobile partitioning wall have structural units that are technically simple to manufacture and to mount and are structured to be universally usable and can be easily and variably disposed at the edge sides of individual wall elements. The wall elements have mounting elements that are horizontally and/or vertically disposed at the edge sides. Modular structural units are laterally insertable into the mounting elements.

23 Claims, 16 Drawing Sheets

U.S. PATENT DOCUMENTS

| | | | | |
|---|---|---|---|---|
| 3,400,504 | A | 9/1968 | Neisewander | |
| 3,557,499 | A | 1/1971 | Dickie | |
| 3,587,205 | A | 6/1971 | Gartside | |
| 3,614,050 | A | 10/1971 | Greenhalgh | |
| 3,638,376 | A | 2/1972 | Howes et al. | |
| 3,717,046 | A | 2/1973 | Takao et al. | |
| 3,755,968 | A | 9/1973 | Williams | |
| 3,798,839 | A | 3/1974 | Kaufman | |
| 3,967,420 | A | 7/1976 | Papsco et al. | |
| 4,073,092 | A | 2/1978 | Williams | |
| 4,084,367 | A | 4/1978 | Saylor et al. | |
| 4,086,734 | A | 5/1978 | Hyashi | |
| 4,102,089 | A | 7/1978 | Paisley | |
| 4,103,463 | A | 8/1978 | Dixon | |
| 4,227,355 | A | 10/1980 | Wendt | |
| 4,263,761 | A | 4/1981 | Kristoff | |
| 4,277,920 | A | 7/1981 | Dixon | |
| 4,395,854 | A | 8/1983 | White et al. | |
| 4,443,978 | A | 4/1984 | Butler | |
| 4,454,690 | A * | 6/1984 | Dixon | 52/126.3 |
| 4,535,578 | A * | 8/1985 | Gerken | 52/243.1 |
| 4,612,744 | A | 9/1986 | Shamash | |
| 4,833,840 | A | 5/1989 | Kalischewski et al. | |
| 5,214,889 | A | 6/1993 | Nienhuis et al. | |
| 5,301,468 | A * | 4/1994 | Kamezaki | 49/225 |
| 5,471,791 | A * | 12/1995 | Keller | 49/317 |
| 5,481,834 | A | 1/1996 | Kowalczyk et al. | |
| 5,577,348 | A | 11/1996 | Keller | |
| 5,603,192 | A | 2/1997 | Dickson | |
| 5,634,305 | A | 6/1997 | Erlanger | |
| 6,079,174 | A | 6/2000 | Williams et al. | |
| 6,082,053 | A | 7/2000 | Bischof et al. | |
| 6,112,466 | A * | 9/2000 | Smith et al. | 49/306 |
| 6,233,878 | B1 | 5/2001 | Krahenbuhl et al. | |
| 6,374,456 | B1 | 4/2002 | Fort et al. | |
| 6,449,905 | B2 * | 9/2002 | Maki | 49/360 |
| 6,581,332 | B1 * | 6/2003 | Kim | 49/358 |
| 6,647,652 | B1 | 11/2003 | Seiber et al. | |
| 6,711,871 | B2 | 3/2004 | Beirise et al. | |
| 6,715,530 | B2 | 4/2004 | Goldsmith et al. | |
| 6,729,085 | B2 | 5/2004 | Newhouse et al. | |
| 6,754,998 | B2 | 6/2004 | Diffrient et al. | |
| 7,603,821 | B2 | 10/2009 | Eberlein et al. | |
| 7,712,270 | B2 | 5/2010 | Guevremont | |
| 2001/0029713 | A1 | 10/2001 | Beck et al. | |
| 2002/0129574 | A1 | 9/2002 | Newhouse et al. | |
| 2002/0157335 | A1 | 10/2002 | Vos | |
| 2004/0003556 | A1 | 1/2004 | Zerbst | |
| 2004/0177573 | A1 | 9/2004 | Newhouse et al. | |
| 2008/0209827 | A1 | 9/2008 | Webb | |
| 2009/0077895 | A1 * | 3/2009 | Tshai | 49/316 |
| 2009/0255193 | A1 | 10/2009 | Behrens et al. | |
| 2009/0260292 | A1 * | 10/2009 | Hansch | 49/340 |

FOREIGN PATENT DOCUMENTS

| | | |
|---|---|---|
| AT | 325 262 | 10/1975 |
| DE | 836247 | 4/1952 |
| DE | 2404874 | 3/1971 |
| DE | 24 04 784 | 8/1975 |
| DE | 9200754 | 4/1992 |
| DE | 19634391 | 3/1998 |
| DE | 29720978 | 3/1998 |
| DE | 299 03 466 | 6/1999 |
| DE | 29903466 | 6/1999 |
| DE | 19907242 | 9/2000 |
| DE | 29724726 | 8/2003 |
| DE | 202004011753 | 9/2004 |
| DE | 202006009867 | 11/2006 |
| EP | 200491 | 11/1986 |
| EP | 0953706 | 11/1999 |
| EP | 1 249 548 | 10/2002 |

OTHER PUBLICATIONS

Written Opinion of the Int'l. Search Authority issued for the underlying International PCT Application No. PCT/ EP2006/008855.

* cited by examiner

MOBILE PARTITIONING WALL

CROSS-REFERENCE TO RELATED APPLICATIONS

This is a U.S. national stage of International Application No. PCT/EP2006/008855, filed on 12 Sep. 2006. Priority is claimed on German Application No. 10 2005 048 157.4, filed on 6 Oct. 2005.

BACKGROUND OF THE INVENTION

1. Field of the Invention

The invention is based on a mobile partitioning wall having wall elements which are displaceably disposed at a running rail.

2. Description of the Related Art

A mobile partitioning wall with several wall elements, which are displaceably guided in a running rail, is known from DE-OS 24 04 874. Each wall element has a supporting structure, which is formed by a surrounding frame consisting of profiles. Covering panels are mounted to both sides of the frame and, moreover, additional add-on and accessory parts are attached thereto. The hollow space between the covering panels and the frame is filled with thermally insulating and sound-absorbent materials.

The frame-based supporting structure results in wall elements having a high weight and requires therefore suspension devices with a correspondingly stable configuration. With such a structure, the increasing requirements with regard to thermal and sound-insulation can only be satisfied when using additional respectively thicker covering panels, while increasing the overall weight.

As mobile partitioning walls, due to varying installation situations and dimensions, are individually manufactured, in particular the realization of the frame requires an expensive and precise dimensional manufacturing and connection of profiles. A provision and production of standardized components for such wall elements is feasible to a very limited extent only.

Moreover, integrating optional structural elements into such wall elements requires an exact definition of the interfaces to the frame. For example, the usual equipment of the wall elements with sealing mechanisms on the top and bottom sides is expensive and, due to structural circumstances of a frame, restricted with regard to the universal application. Variants in the structure or the installation situation require individual fabrication again. Modifications on-site are only possible within the given tolerance.

EP 0 629 752 B1 describes a mobile partitioning wall, in which upper and lower terminal strips are activated by pneumatic lifting members for the purpose of sound insulation and for guaranteeing the stability of the individual wall elements. Complicated manufacturing and limited repair possibilities are caused by the central disposition of the lifting mechanism within the respective wall element and, using said mechanism in a transparent wall, results in a negative appearance.

The partitioning wall elements in the Austrian patent specification AT 325262 consist of different materials. In order to achieve a high sound insulation, the gap to a floor guiding rail and the gap to a running rail respectively to the ceiling are closed by a profile being able to move upwards and out of the floor guiding rail.

SUMMARY OF THE INVENTION

The object of the invention is to provide a mobile partitioning wall with several wall elements displaceably mounted at running rails, the structural units thereof being technically simple to manufacture and to mount, and universally applicable, and being able to be simply and universally disposed at the edge side of individual wall elements.

According to the invention, mounting elements are disposed at edge sides of the wall elements, and modular structural units are laterally insertable in the mounting elements. The invention is applicable to both automatically and manually displaceable wall elements of the partitioning walls.

The mobile partitioning wall according to the invention has the advantage of substantially simplifying manufacturing and mounting through a modular and uniform structure of the structural units. For this purpose, the individual wall elements of a partitioning wall have a mounting element, in which the structural units, like a modular building system, are disposed to be exchangeable and expandable by means of a uniform mounting and fastening technique, The modular structure allows for a simple assembly of most different functional modules such that, during mounting to the wall elements, it is just required to fasten the structural units and, if necessary, to connect them to the peripheral structural parts. The inventive structure allows for a complete integration of all structural units into the mounting element, such that any intervention in the surface plane of a wall element is avoided and the sound insulating parameters are not modified.

The mounting elements are manufactured to have excess length and they are kept in stock, pre-mounting of structural units being possible to a large extent. The mounting elements are shortened to the necessary length during final mounting to the wall elements. As, substantially, the structural units are not located at the ends, shortening is uncomplicated, even in the assembled condition. This results in very few standard elements to be manufactured for the stock, which are adaptable to a multiplicity of dimensions and installation variants.

Each functional module has a profiled elongated mounting element into which the individual structural elements are integrated. Opposite guiding grooves, into which the structural elements are uniformly inserted, are formed in the mounting element. For this purpose, the structural elements have one base plate, which is displaceably guided in the grooves, and thus can be flexibly positioned in longitudinal direction. Depending on the configuration, several structural elements can be disposed on one base plate as well. In the event mechanical or electrical connections to the running rail or to adjoining wall elements are required, corresponding flexible and variable connections allow for a simple and subsequent adjustment.

In the embodiment as a sealing module, a functional module has a sealing strip, a mechanical lifting mechanism, a drive and a power supply unit, as well as attachments for a carriage. Further optional structural elements are possible. There are many options for the constructional configuration of the structural elements and their cooperation.

Advantageously, the sealing module is activated via an electrically driven motor. The motor is likewise disposed in the sealing module, the motor-driven movement being transferred to the sealing strip via several reversing mechanisms. The energy supply and the activation of the motor may be done in the most various ways. Contactless, as well as contact-controlled or line-controlled systems are possible. Systems without wires use energy storage units in the form of accumulators, which need to be temporarily recharged or exchanged. A contact-controlled variant allows for a supply via friction contacts in the running rail of the partitioning wall system. Furthermore, it is possible to supply the sealing modules with power via plug-in connections at the longitudinal edges of the wall elements. In this case, energy from a stationary source is applied exclusively in the event of the final positioning of all wall elements, when all plug-in connections are contacted. In this case, each motor can be supplied directly or with interposed energy storage.

For cases of emergency, in particular during power outages, a mechanical actuation of the sealing modules is basically always possible. However, this function may be available as the standard actuation or as an alternative variant as well, such as to create a semi-automatic system. Preferably, the upper and lower sealing modules are then mechanically connected, such as to achieve a synchronous actuation of both sealing strips with one operation.

The reversing of the rotational motor movement into a translational lifting and lowering movement for the sealing strip is realized via gear assemblies, preferably via a cable pull or a spindle, which ultimately move the sealing strip. In this case, and depending on the requirement, the sealing strip can be retracted by motor power or projected by motor power.

In particular when using a spindle, both the motor and the spindle, as well as a lever connected to the sealing strip, are disposed on a base plate and constitute one mounting unit. The spindle can be used as a compact unit or in conjunction with articulated scissors. The spindle and the motor can be disposed one behind the other or on top of each other. The line disposition reduces the constructional height of the mounting unit. The mechanical connection to the sealing strip is realized by means of the lever. In addition, carrying bolts of the carriage serve as a guidance, these carrying bolts being likewise positioned by means of base plates in the base body of the sealing module. In this case, the sealing strip is retracted as well projected by motor power.

In the embodiment with a cable pull, a base plate with the motor and the cable pulley is provided. Furthermore, there are two carrying bolt elements with separate base plates, at which spring tables are elastically supported and additionally coupled to the sealing strip. Cables, exiting on both sides of the cable pulley, are connected to the spring tables and actively retract the pre-tensioned sealing strip upon actuation of the motor.

The sealing strip is non-positively fastened to corresponding devices of the lever mechanisms and positively slides in the rail-like mounting element. A friction-reduced guidance is thus achieved during displacement, while reducing the penetration of dirt and the running noise at the same time. Additional sealing rubber lips are disposed at the edges.

Oblong holes, through which the carrying bolts of the carriages pass, extend at the upper side of the sealing strips. Disposing the oblong holes the respectively carrying bolts off-center prevents the sealing strip from canting during displacement. The formation of oblong holes also allows for varying the position of the carriages.

In addition to the horizontal termination of the wall elements, such sealing mechanisms allow for sealing vertical edges as well, by following the same principle, in particular at terminal wall elements.

At the edge, the mounting elements are either disposed to be concealed within a recess in the wall element or they are surface-mounted on the respective edge of the wall element. By disposing the mounting element in a recess, it becomes completely invisible. In the surface-mounted embodiment, the positioning and fastening is realized without forming a recess. Positively cooperating contours between the mounting element and the recess respectively the edge are particularly advantageous, because this achieves an additional anchoring of the mounting elements, in addition to the fastening described hereinafter.

Preferably, the fastening of the mounting elements is realized to be integral with the layer forming structure of the wall elements, because, on the one hand, the establishing of a core of the wall element is used to form a recess and, on the other hand, the bonding of the layers is simultaneously utilized for fastening the mounting elements with the result that no separate process steps are necessary. If required, corresponding recesses can be milled into the panel on the site of installation and the mounting elements can be mounted therein, respectively the mounting elements can be surface-mounted and fastened.

Preferably, the mounting elements are used in the shape of profiles, thus creating exactly defined and form-stable mounting spaces. The profiles are adapted to the shape of the recess respectively to the shape of the edge and preferably they are formed to be U-shaped or H-shaped. On the inside the profiles have a variety of channels, chambers and bores, in order to be able to position and fasten the different structural elements. Overall, the profiles create a uniform, preferably surrounding mounting area so that modular structural units can be disposed at optional positions.

Altogether the manufacturing and mounting expense is substantially reduced, because individual mounting solutions do not need to be provided any more, and mainly system components are used instead. In particular the manual manufacturing steps are substantially reduced, because a major portion is now automatized. The wall element can be shipped likewise as an assembly kit. Final measures of cutting the panel to size, in particular for the add-on parts, and their final mounting can be done on the installation site as well.

In order to realize for example a functional outside termination for rooms or for buildings with regard to an acceptable thermal, sound and/or fire insulation at the floor and ceiling areas, sealing modules, which seal towards the running rail respectively towards the floor, are horizontally inserted at the top and bottom of each wall element. Even slight irregularities in the floor can be compensated for by such sealing modules. Projecting and retracting is effected via a mechanism, which is operated via an automatically or manually activated drive unit. Horizontally disposed mounting elements are preferably made from metal, because at this location heavy and in particular load-transferring structural units are disposed.

The vertical border areas of each wall element, at least sectionally, are formed as a profile, in order to achieve a positive connection to the border areas of adjoining wall elements. For this purpose, mounting elements are disposed in particular at the vertical edges, wherein sealing profiles or molded parts are mounted, which cooperate with a complementarily formed border area of the adjoining wall element, and provide a soundproof and stable connection. Preferably, vertically disposed mounting elements are made from plastic material, because, on account of the material, a sound decoupling is thus realized.

The selection of materials of a wall element and their layering is done in particular in consideration of weight-specific and acoustic aspects, the external layers being selected additionally in consideration of visual and practical aspects. Complicated manufacturing of a supporting frame structure is eliminated, because just the cutting to size and the connecting of the layers is required to provide the basic structure for a wall element.

The different materials of the layer are kept as supplies in stock, in panel-shape and are cut to the required dimension when needed. Preferably, dimensioning in a raster measure is advantageous in this case, in order to efficiently realize the different dimensions. Realizing the basic structure of the wall element is done by arranging layered panels and applying adhesives and filling compounds. Thus a variable selection and disposition of layers and filling materials allow for quickly and easily replying to specific customer needs.

A wall element according to the inventive structure has a core which, on both sides, is covered by one exterior shell, respectively. Preferably, the exterior shell is multi-layered and consists of an exterior cover layer, a middle layer and an interior layer. Overall, the two exterior shells are formed to be heavy and soundproof and are sonically separated by the preferably soft core material. Through the full connection, preferably bonding, all layers and materials of the wall element are combined to a self-supporting unit. The sound insulation can be realized at a reduced expense, because the selection of appropriate materials and their assembling already result in a considerable improvement. With the intention to improve the rigidity of the wall element, while maintaining the sound insulation at the same time, the contact surfaces of the layers, depending on the material selection, are profiled.

Through the selection of most different materials, the use of panel-shaped and foamed layers and their connection to a structure in a sandwich technique, the individual properties are advantageously combined in such a way that they sum up to a considerable improvement. The wall element has considerably higher bending and torsional rigidities, for example, than the sum of the properties when separately using the layers of exterior shell and core. Such composed panels transfer substantial loads as well. The structure of the exterior shell, as well as the thickness and density of the core are decisive factors. Compared to a frame structure, the result is a reduced wall thickness and a lower weight for an increased stability.

The core material can have a honeycomb structure, which in particular is formed of paper or aluminum. Alternatively, solid material made from polystyrene foam, PU-foam, mineral wool, rock wool or the like can be used to form the core.

Preferably, the exterior shells are multi-layered. Metallic materials, such as sheet steel or sheet aluminium, and furthermore, plastic material (PVC, PC), laminar materials, fibreglass reinforced plastics (GRP), gypsum, wood, cork, etc. are suitable for the middle layer. The layer, disposed on the inside between the middle layer of the exterior shell and the core, serves as an increase to the shell weight and as a damping material and preferably consists of bitumen. This middle layer functions at the same time as a support for the exterior cover layer, which forms the visible surface. The cover layer may be a priming film, a laminate, laminar material or melamine resin. Furthermore, veneers, textile, glass or magnetic surfaces can be used to form the cover layer.

Bonding materials and bonding techniques are used for connecting the individual layers of the exterior shell. The so-called long fiber injection method (LFI) is used as a preferred method. In this case, fiberglass strands are cut and, in a single operational step, are fed simultaneously with PUR components to a tool device and blended. The finished mixture is then sprayed between the corresponding layers of the exterior shell and, once hardened, creates a permanent connection.

A particularly advantageous structure of the wall element is achieved with a soft core made from PUR-foam or melamine foam, which is enveloped on both sides by a weighting layer of bitumen. Then the middle layer of the exterior shell follows, consisting of GRP enveloped paper honeycombs filled with PU-foam, and an exterior cover layer, depending on customer specifications. Such a combination of materials has excellent acoustic properties and constitutes the optimum solution with regard to the parameters of sound insulation and weight per unit area.

Such structured wall elements are suitable to build partitioning walls having the most different configurations. In particular, the substantial weight reduction achieves a lower load on the suspension device and on the drive means and, on the other side, by increasing the sound insulation, the multiplicity of application possibilities has grown.

The wall elements can be formed as solid elements, passage door, angle element, window element, compensating element, swing leaf, double-action leaf or as following automatic doors. All wall elements can be moved out of the axis of the partitioning wall and parked at a predetermined location in a space saving manner. Each wall element is displaceable by means of a carriage at one or two points in a running rail attached to the ceiling.

The overall partitioning wall fulfils the requirements of the thermal insulation regulation such that, even at low outside temperatures, there are no disadvantages as to energy and thus high cost.

BRIEF DESCRIPTION OF THE DRAWINGS

In the Figures, similar or similarly functioning structural parts are referenced with identical numerals.

DETAILED DESCRIPTION OF THE PREFERRED EMBODIMENTS

Figure 1:
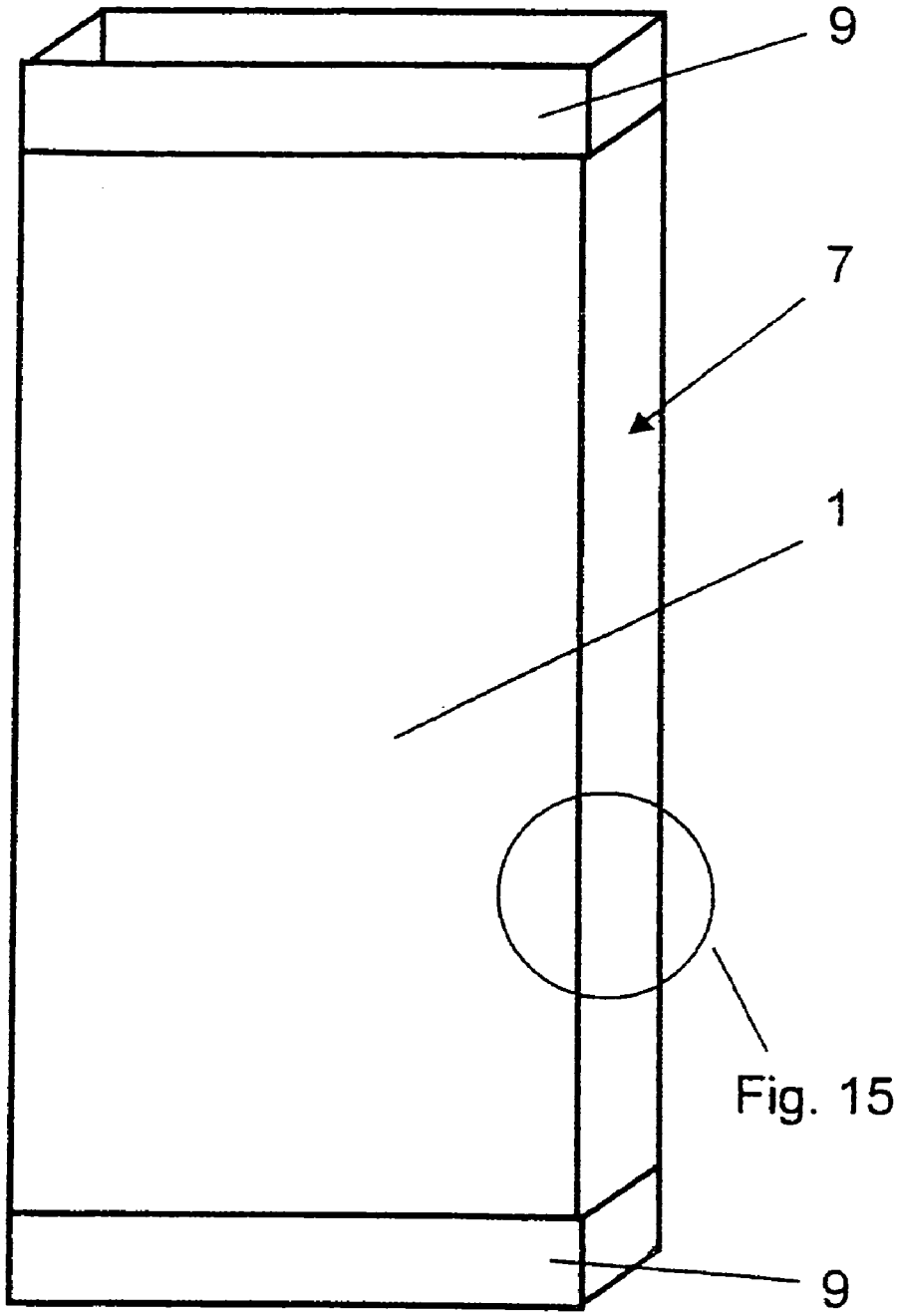
FIG. 1 shows a diagrammatical structure of a wall element.

A mobile partitioning wall is composed of several panel-like, independently displaceable, suspendedly supported wall elements 1 and is suitable as a room divider or as an outside termination. Depending on the execution, the individual wall elements 1 may be displaced manually or driven by motor. All wall elements 1 can be moved out of a space-saving parking position, a so-called stacking location, and into the axis of the partitioning wall and be secured there.

For the sake of clarity, in all Figures a wall element 1 is diagrammatically and partially illustrated, in order to be able to describe the corresponding structure in a correspondingly detailed form.

In the following Figures described below, wall elements 1 are illustrated having respectively one mounting element 9 disposed at each horizontal edge. The mounting element 9 includes respectively one sealing mechanism 10 realizing a functional termination of rooms or buildings with regard to an acceptable thermal, sound and/or fire insulation in the floor and ceiling areas. For sealing purposes, the sealing mechanism 10 is pressed out of the mounting element 9 against the running rail and/or against the floor, wherein, in the inactivated condition, all structural units 12, which are associated to the mechanical system, are completely concealed in the respective mounting element 9. Even minor irregularities in the floor can be compensated for through the disposition of these sealing mechanisms 10. Projecting and retracting the sealing mechanisms 10 is realized via an automatically or manually activated drive unit. At the upper horizontal sides of the wall elements 1, carriages, which are not illustrated in more detail, are disposed, by means of which the wall elements 1 are displaceable in a running rail fastened to a ceiling of a building.

The mounting elements 9 include various structural units 12, such as coupling elements, lifting members, resetting members, drive elements, suspension devices, floor guides, sealing means and electrical equipment. The structural units 12, serving for the bracing respectively the sealing the wall element 1, are completely disposed in the mounting element 9. The system is thus suitable for use in transparent partitioning walls, because there is no visual interference with its appearance.

Further mounting elements 9 are inserted in or surface-mounted on the vertical edges of the wall element 1 or other suitable locations of the wall element 1. Depending on the intended utilization, the mounting elements 9 then include sealing mechanisms 10, separate sealing strips, power supply elements, servicing means and further system components.

Preferably, the mounting elements 9 are profiled with shapes which provide the exactly defined and form stable mounting spaces. The profiles 9 are adapted to the shape of a recess 11 the shape of the edge and preferably are formed to be U-shaped or H-shaped. On the inside, the profiles 9 have a variety of channels, chambers and bores, in order to be able to position and fasten the different structural units 12. Overall the profiles 9 create a uniform, preferably surrounding mounting area such that modular structural units 12 can be disposed at optional locations.

The modular structure of the sealing mechanisms 10 substantially simplifies the manufacturing and the mounting and is described based on the following Figures. According to the modular building system and by means of a uniform mounting and fastening technique, the sealing mechanism 10 is disposed in the mounting element 9 such as to be exchangeable and expandable. The mounting element 9 is disposed at an upper horizontal edge of a wall element 1 and concealed in a recess 11, which is machined therein. Fastening the mounting element 9 is done either during manufacturing of the wall element 1 through positive connection or subsequently during a bonding process.

The different structural units 12 are laterally inserted into the mounting element 9, grooves 18 allowing for a flexible positioning in longitudinal direction. The structural units 12 have one base plate 19, which is displaceably guided in the grooves 18 on both sides and, preferably, is fastened by means of a not-illustrated screw connection. The complete sealing mechanism 10 has a sealing strip 20, a lifting mechanism 21 and a motor drive 22, as well as carriage fastenings 23.

Figure 2:
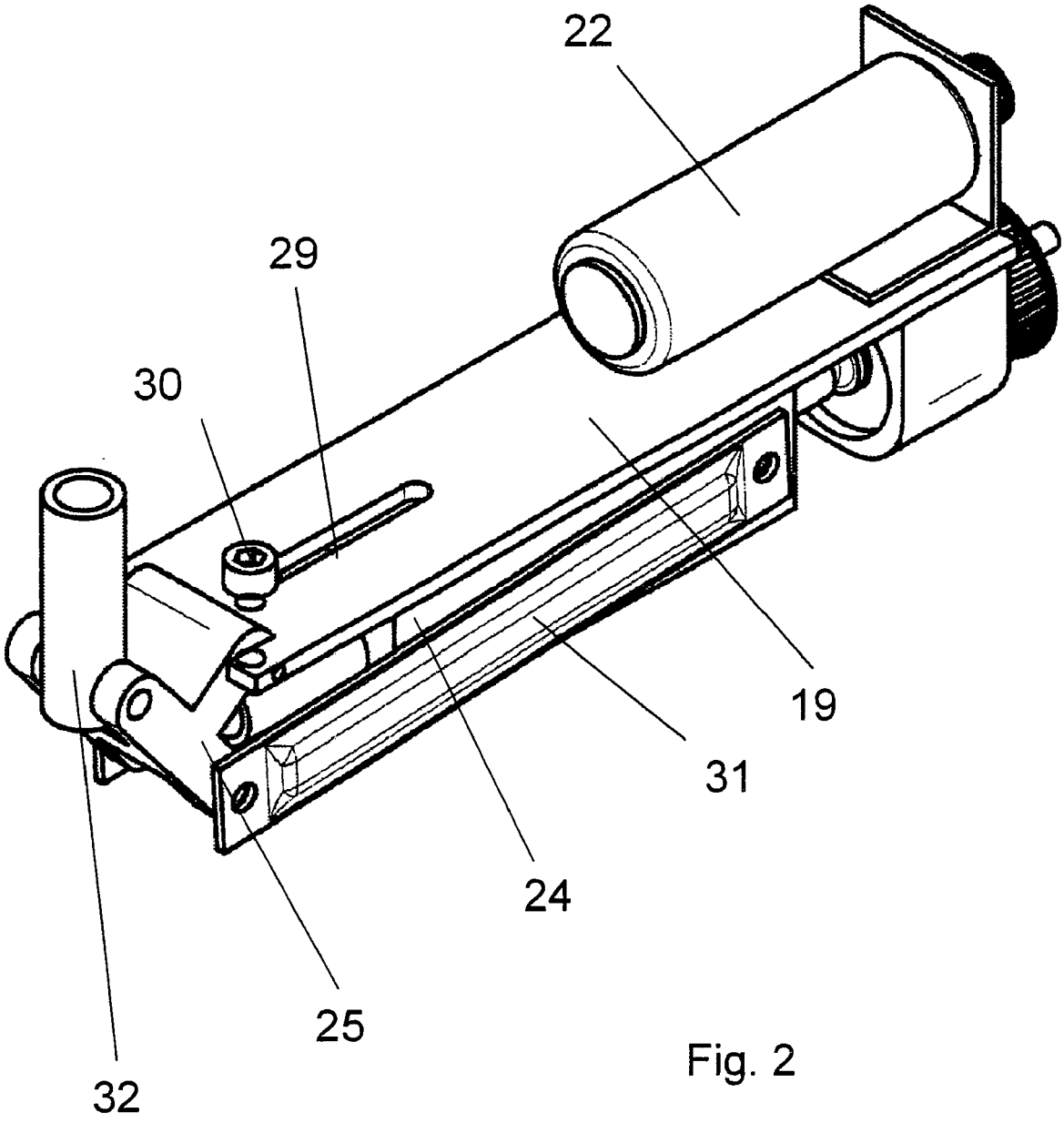
FIG. 2 shows a perspective view of a spindle drive.
Figure 3:
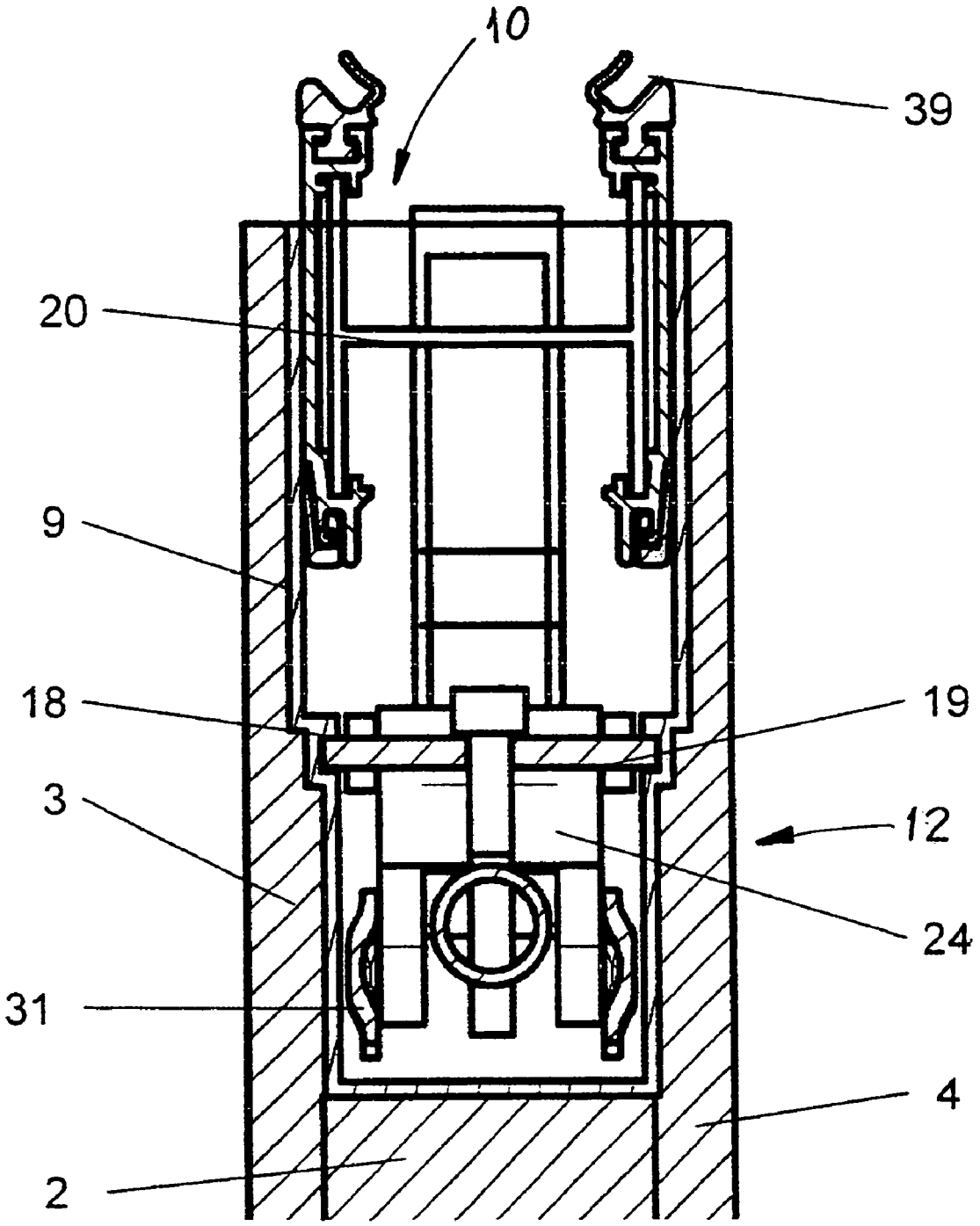
FIG. 3 shows a cross-section through a sealing module with spindle drive.
Figure 4:
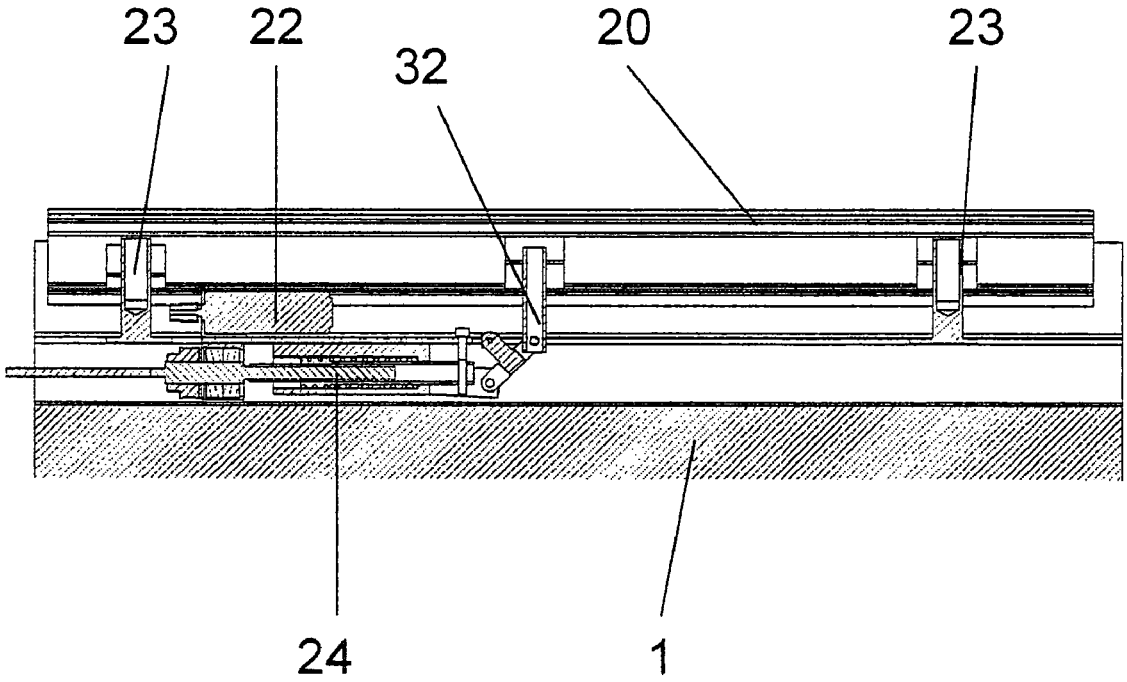
FIG. 4 shows a longitudinal section through the sealing module according to FIG. 3, in the mounted condition.

According to FIGS. 2 to 4, the motor 22, the lifting mechanism 21, in the shape of a spindle unit 24, and a lever 25 as well, which is connected to the sealing strip 20, are disposed on a common base plate 19 and represent a modular structural unit, whereas the carrying bolts 23 for the carriages have separate base plates 19, respectively. The motor 22 is located above the base plate 19, whereas a mechanical spindle unit 24, which acts upon a lever 25 that is likewise disposed at this base plate 19 and ultimately operates the sealing strip 20, is disposed below the base plate 19. In this case, an output shaft of the motor 22 is connected to a shaft of the spindle unit 24 via a toothed belt 26.

The spindle unit 24 consists of the spindle 27, which is rotatably supported in a screw housing 28. The screw housing 28 is displaceably fastened at the underside of the base plate 19, a screw 30, which holds the screw housing 28, is passed through an oblong hole 29 of the base plate 19. A T-shaped lever 25, which, on the one hand, is connected to the sealing strip 20, and, on the other hand, to the spindle unit 24, is rotatably supported at the front side of the base plate 19. In this case, arms 31 are disposed on both sides of the screw housing 28 on its outside, which arms establish the connection to the lever 25 and, in addition to the horizontal movement, allow for a slight rotary movement. Thereby the other end of the lever 25 is moved vertically and displaces the sealing strip 20 against the running rail. The fastening of the sealing strip 20 at the lever 25 is done via a push-rod 32, which is rotatably fastened at the lever 25, the positioning of the sealing strip 20 in the push-rod 32 being adjustable by means of a screw thread. The off-centre disposed carrying bolts 23 of the carriages serve as an additional guiding for the sealing strip 20. The sealing strip 20 is retracted as well projected by motor power.

Figure 5:
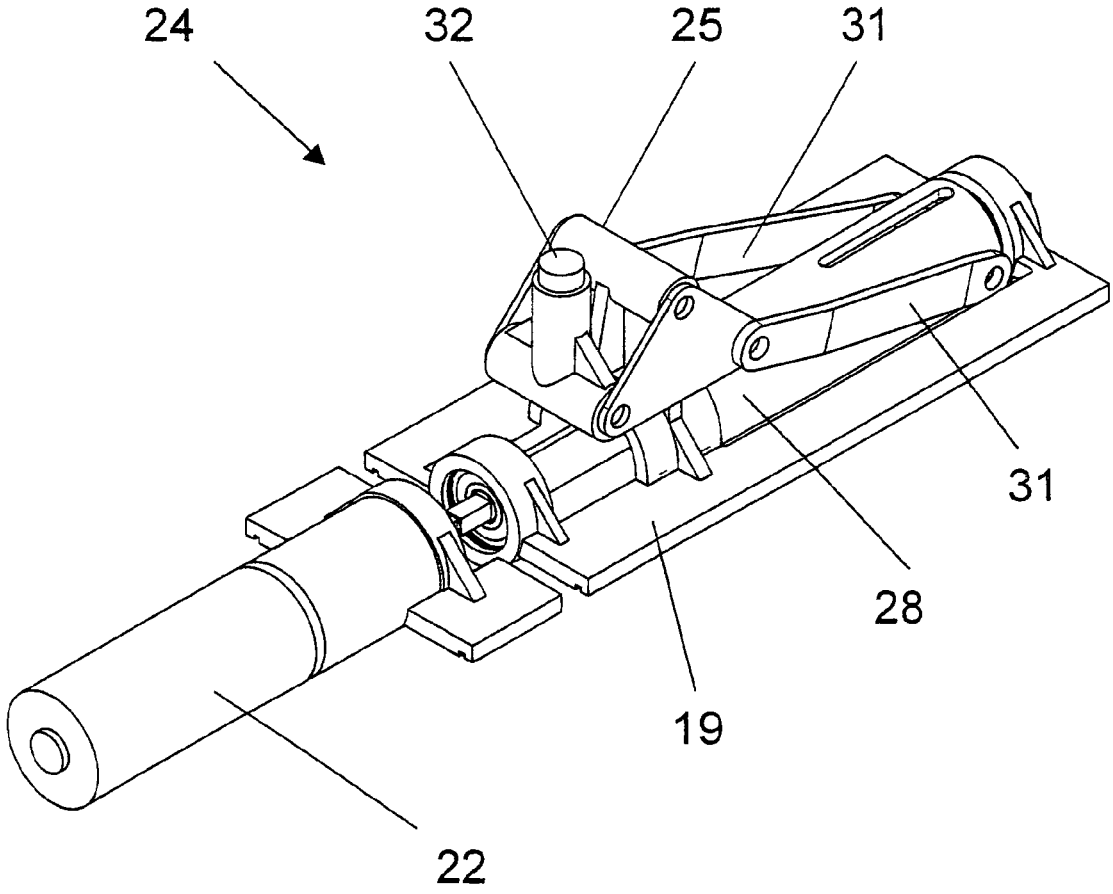
FIG. 5 shows a perspective view of a sprindle drive according to another embodiment.
Figure 6:
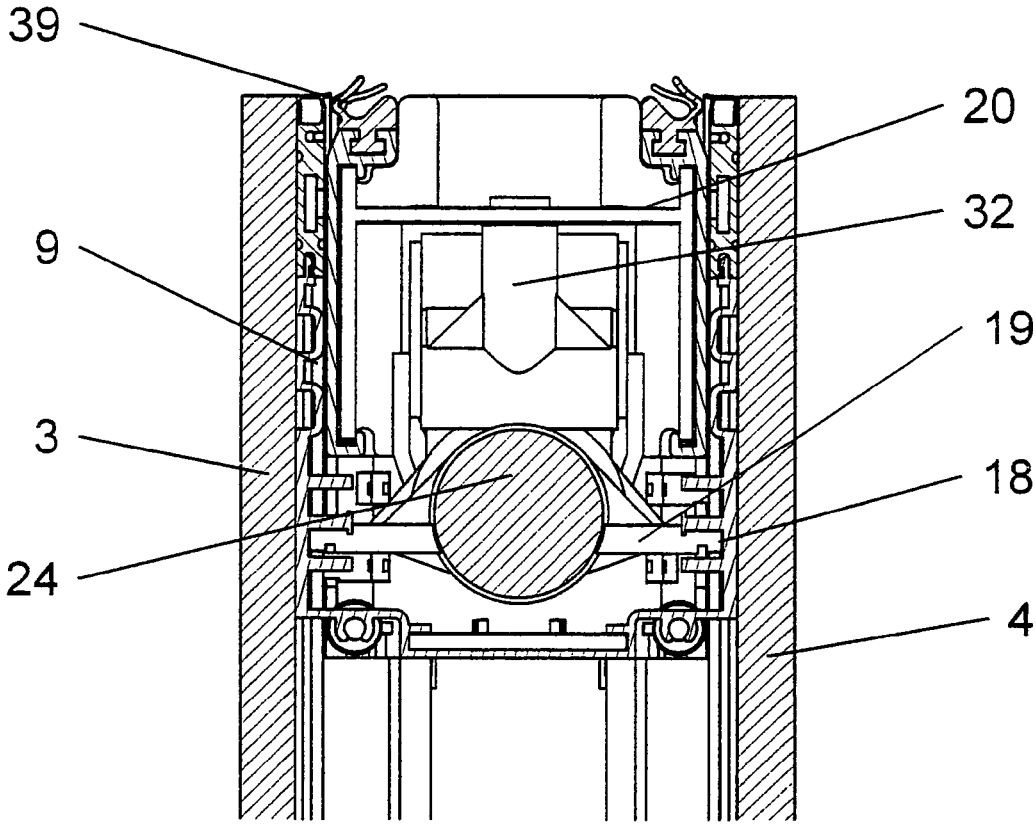
FIG. 6 shows a cross-section through a sealing module with spindle drive according to FIG. 5.
Figure 7:
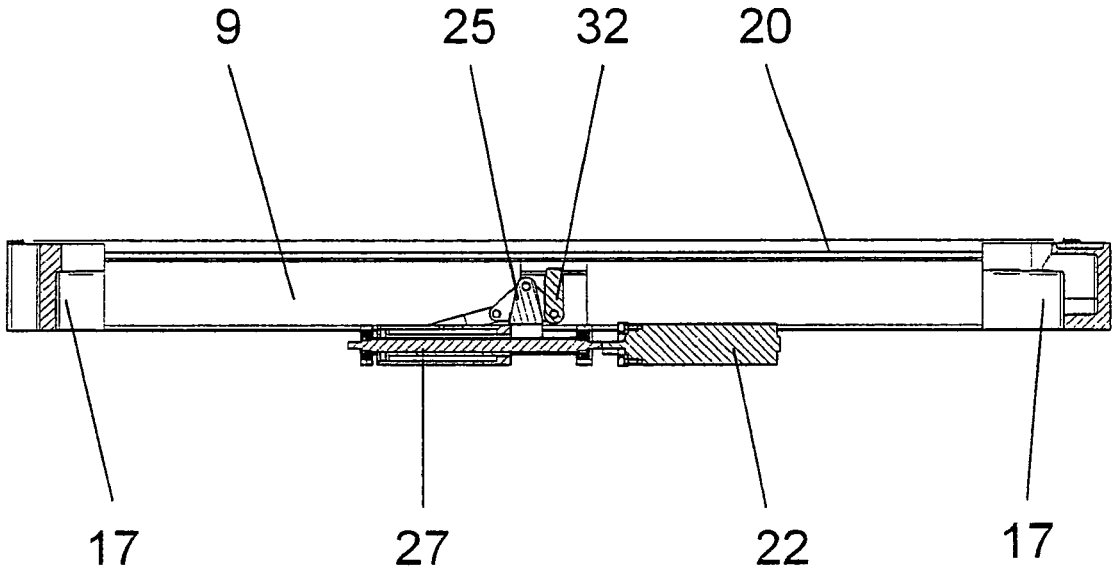
FIG. 7 shows a longitudinal section through the sealing module according to FIG. 5, in the mounted condition.

Another embodiment of a spindle drive 24 is illustrated according to FIGS. 5 to 7. In this case again, the motor 22, the lifting mechanism 21 in the shape of a spindle 27, as well as a lever 25 connected to the sealing strip 20 are disposed on a common base plate 19 and represent one mounting unit, whereas carrying bolts 23 for the carriages have separate base plates 19, respectively. The motor 22 and the spindle unit 24 are disposed in one row, one behind the other and gear-connected. Both units are surrounded by a base plate 19, which is either disposed as a single piece at one of the two units or fastened separately.

The spindle unit 24 consists of the spindle 27, which is rotatably supported in a screw housing 28. The screw housing 28 is fastened centrally at the base plate 19. A toggle lever 25, which, on the one hand, is connected to the sealing strip 20 and, on the other hand, to the spindle 27, is rotatably supported on the outside of the screw housing 28. In this case, arms 31 are disposed on both sides of the screw housing 28 on its outside, which arms establish the connection to the lever 25 and, in addition to the horizontal movement, allow for a slight rotary movement. Thereby the other end of the lever 25 is moved vertically and displaces the sealing strip 20 against the running rail. The fastening of the sealing strip 20 at the lever 25 is realized via a push-rod 32, which is rotatably fastened at the lever 25, the positioning of the sealing strip 20 being adjustable in the push-rod 32 by means of a screw thread. The off-centre disposed carrying bolts 23 of the carriages serve as an additional guiding for the sealing strip 20. The sealing strip 20 is retracted as well as projected by motor power.

Figure 8:
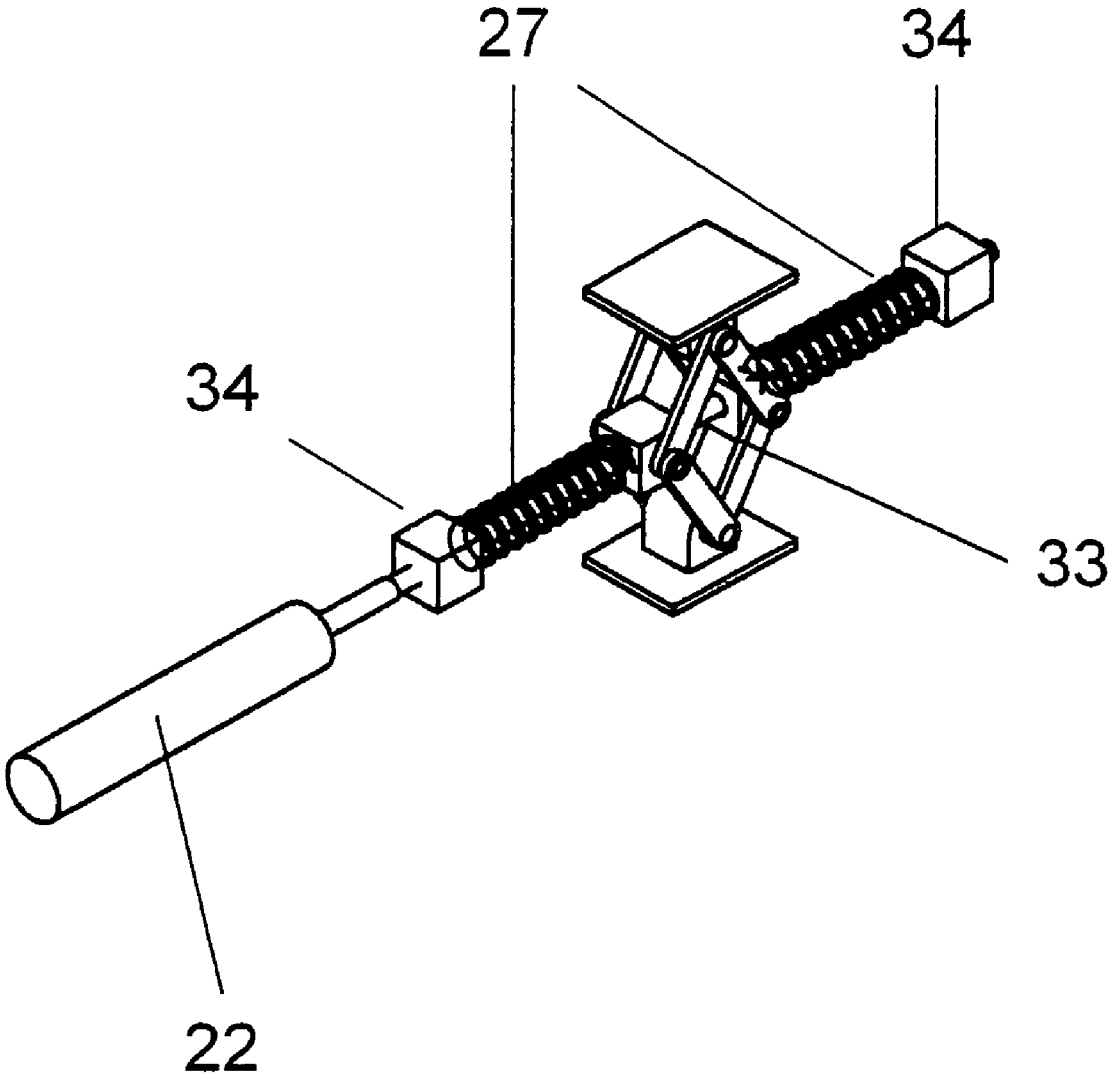
FIG. 8 shows a perspective view of a base plate with a spindle drive according to another exemplary embodiment.

In another embodiment according to FIG. 8, a spindle unit 24 is again disposed in one row with the drive motor 22. The spindle unit 24 consists of articulated scissors 33, wherein, through displacing the spindle 27, articulated scissors 33, which are spring-supported between nuts 34 located respectively at the ends of the spindle 27, are lifted and lowered.

Figure 9:
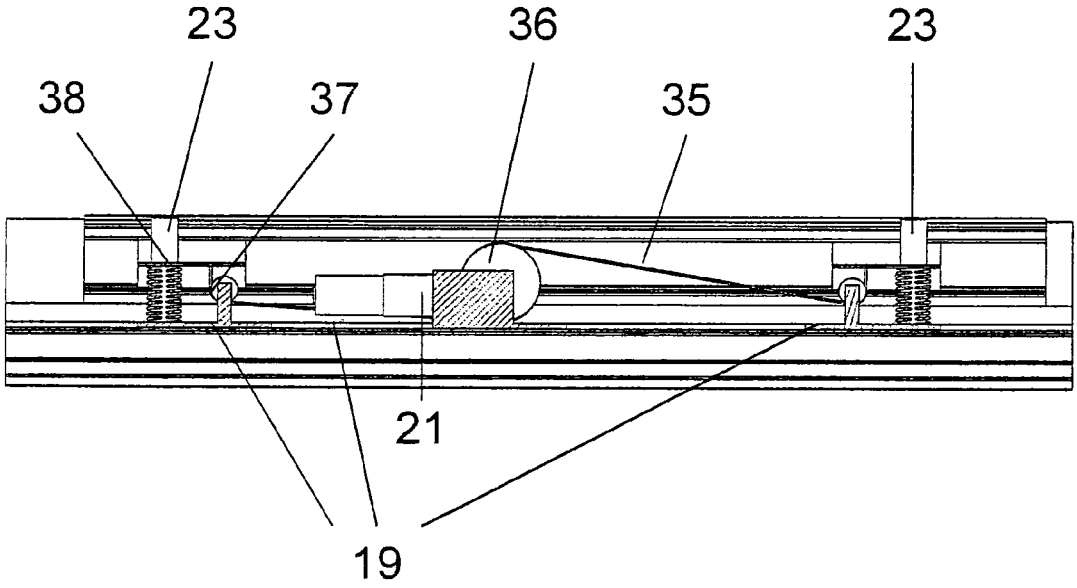
FIG. 9 shows a longitudinal section through a sealing module with a cable pull drive in the mounted condition.
Figure 10:
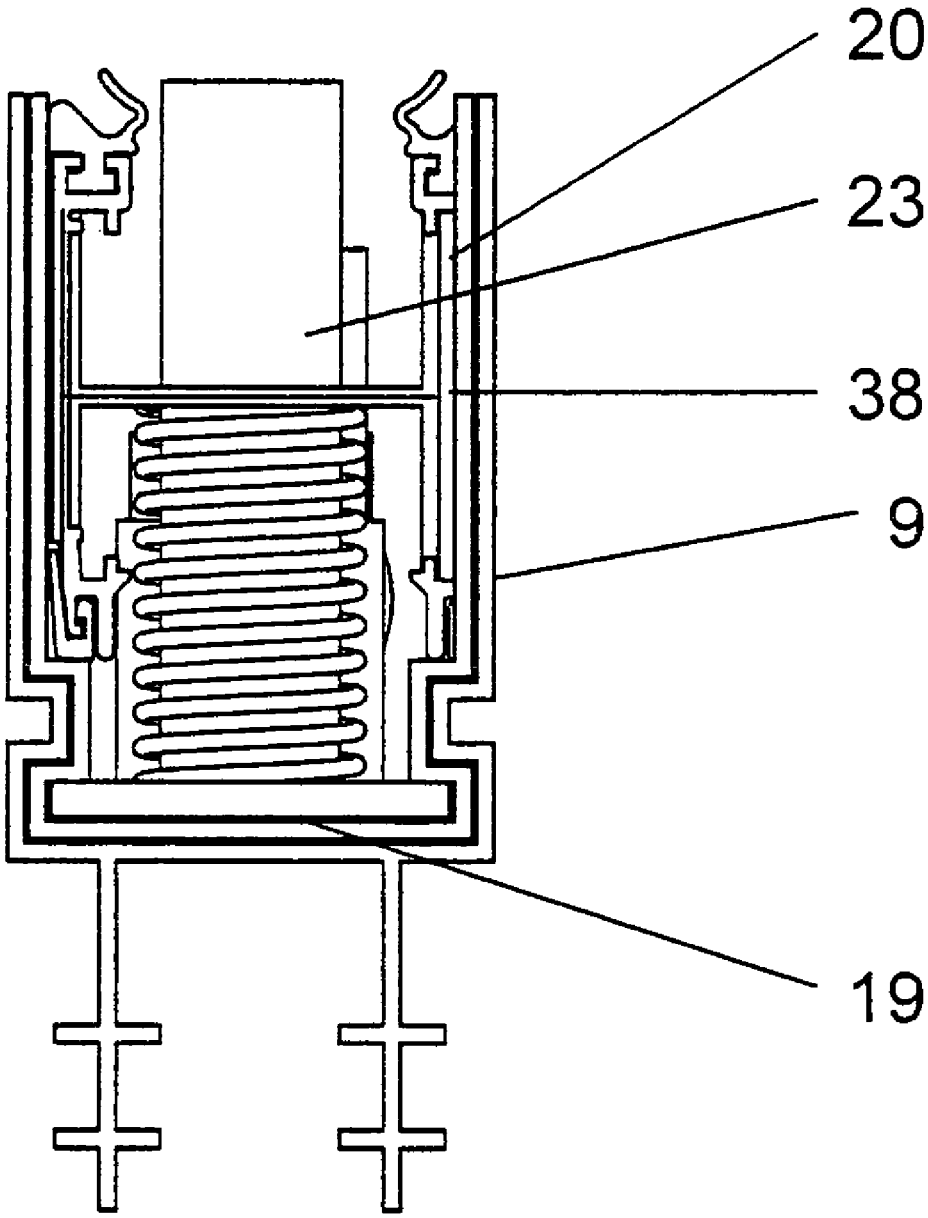
FIG. 10 shows a cross-section through the sealing module according to FIG. 9.

In the embodiment according to FIGS. 9 and 10, the lifting mechanism 21 is realized by means of a cable pull 35. In this case, a base plate 19 with a drive 22 and with a cable pulley 36 is provided. Furthermore, there are two distinct carrying bolt elements 23 each having one base plate 19. A return pulley 37 is disposed at each of these base plates 19. In addition, there is a spring supported table 38, which is coaxially disposed about the carrying bolt 23 and coupled to the sealing strip 20. An output shaft exiting laterally from the drive 22 is directly coupled to the shaft of the cable pulley 36. Exiting on both sides of the cable pulley 36, cables 35 act upon the tables 38 via the return pulleys 37 and thus upon the sealing strip 20. As, on account of the spring action, the sealing strip 20 is in the projected condition, the cables 35 are wound up when the motor 22 is activated, and thus the sealing strip 20 is retracted through the motor operation.

The sealing strip 20 is non-positively fastened to the lever 25 (FIGS. 2 to 8) respectively to the spring tables 38 (FIGS. 9 and 10) and positively slides in the rail-like mounting element 9. A good guidance is thereby achieved during displacement, while reducing the penetration of dirt and the running noise at the same time. Additional sealing rubber lips 39 are disposed at the upper edges. Slots, through which the carrying bolts 23 of the carriages pass, extend at the ends of the sealing strips 20. The off-centre disposition of the carrying bolts 23 prevents the sealing strip 20 from canting during displacement. The position of the carriages can be varied through the extra length of the slots.

The activation of the sealing module is realized via a drive 22 in the shape of an electrical motor, preferably a direct current motor. The energy supply and control of the motor 22 can be done in most different ways, which will be explained in the following based on FIGS. 11 to 14, the functional modules respectively being distinctly or commonly supplied.

Figure 11:
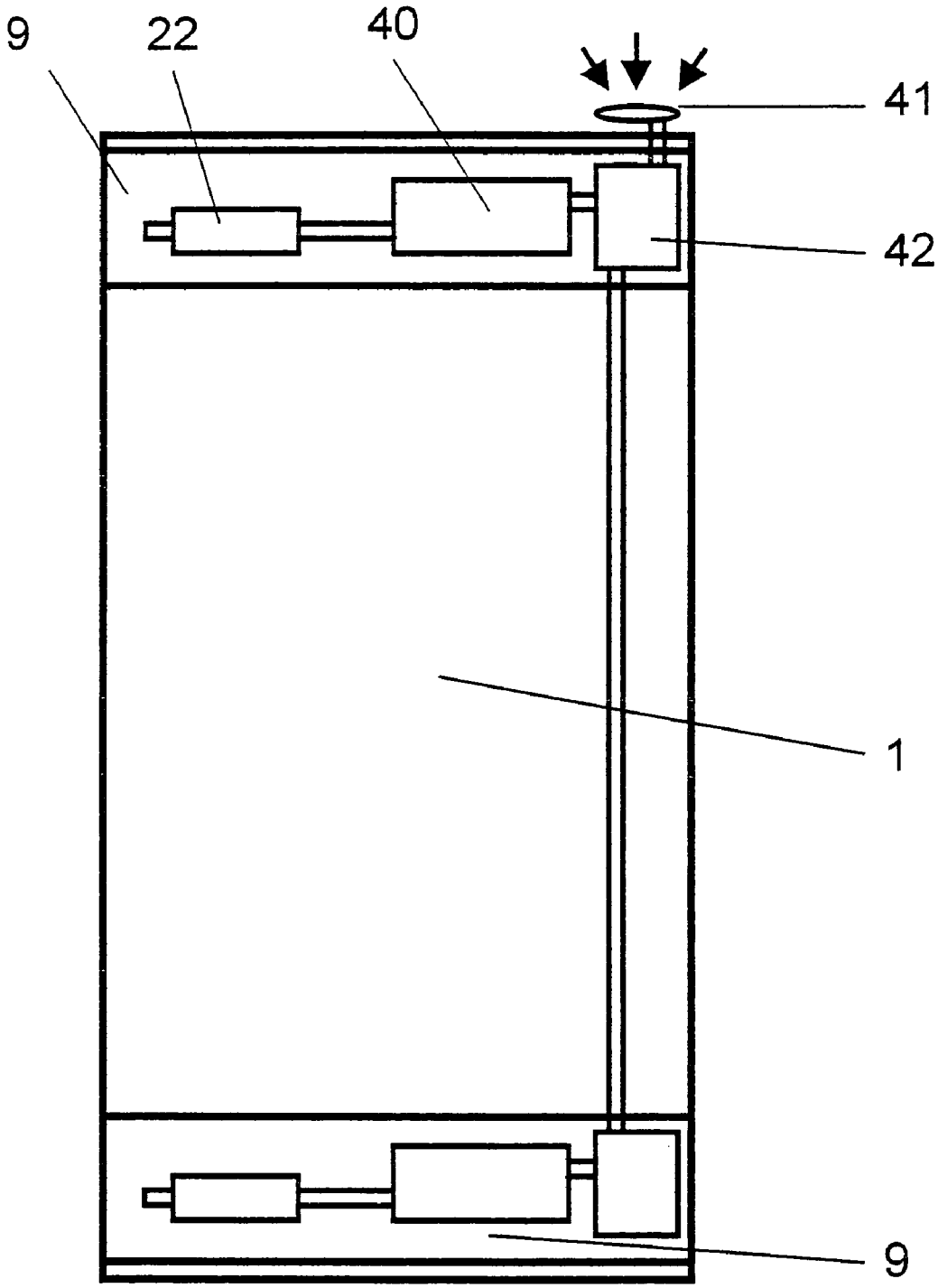
FIG. 11 shows a basic illustration of an energy supply of a wall element.

Contactless as well as contact-controlled respectively line-controlled systems are possible. When using contactless systems, energy storage units 40 in the shape of accumulators are utilized, which can be recharged temporarily or exchanged. The energy respectively data transfer 41 is realized contactless, the energy and the data being transformed and processed in an electrical unit 42. Such embodiment is illustrated in FIG. 11.

Figure 12:
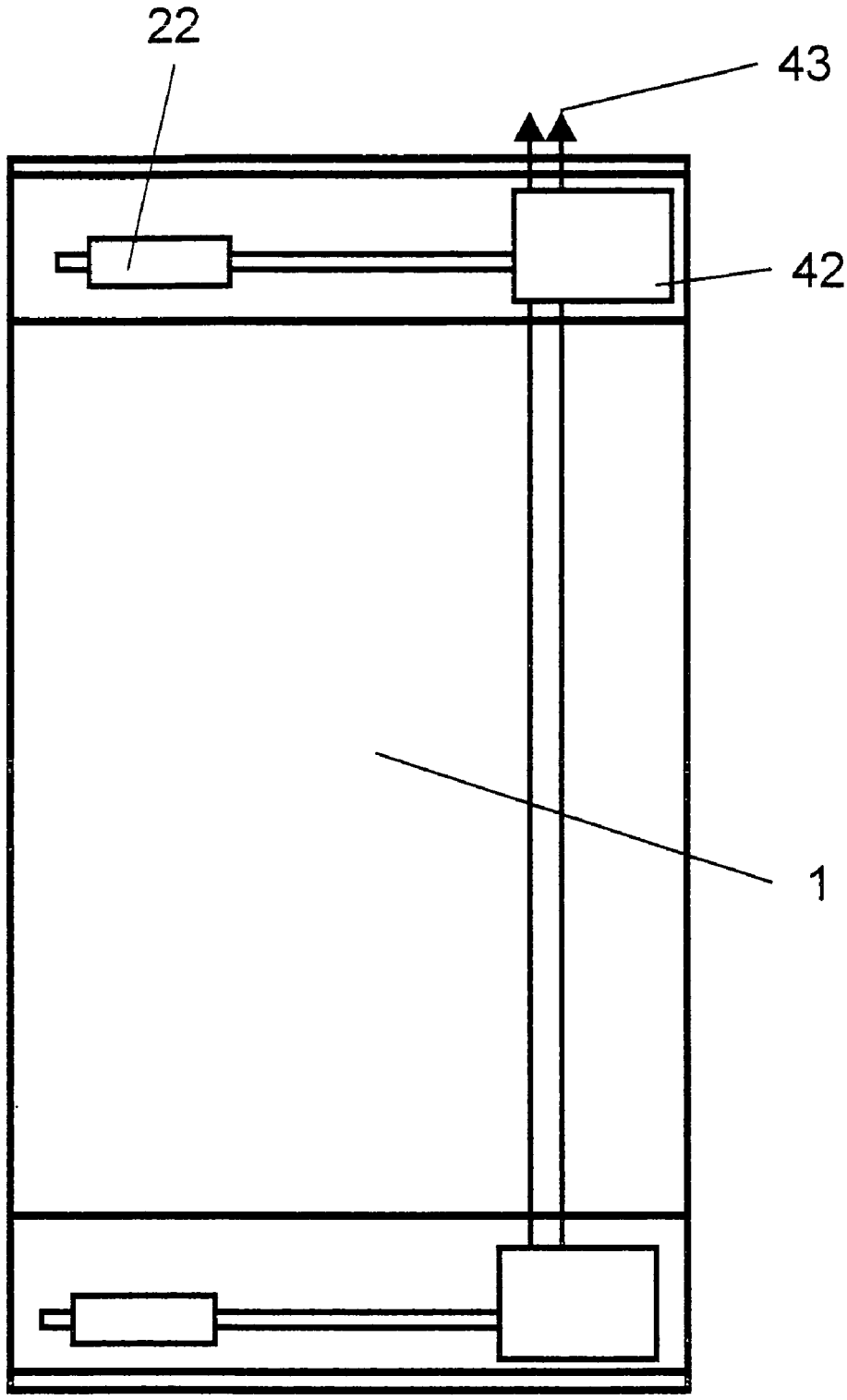
FIG. 12 shows a basic illustration of another energy supply of a wall element.

A contact-controlled variant allows for a supply via friction contacts 43, which are disposed in the running rail of the partitioning wall system (FIG. 12).

Figure 13:
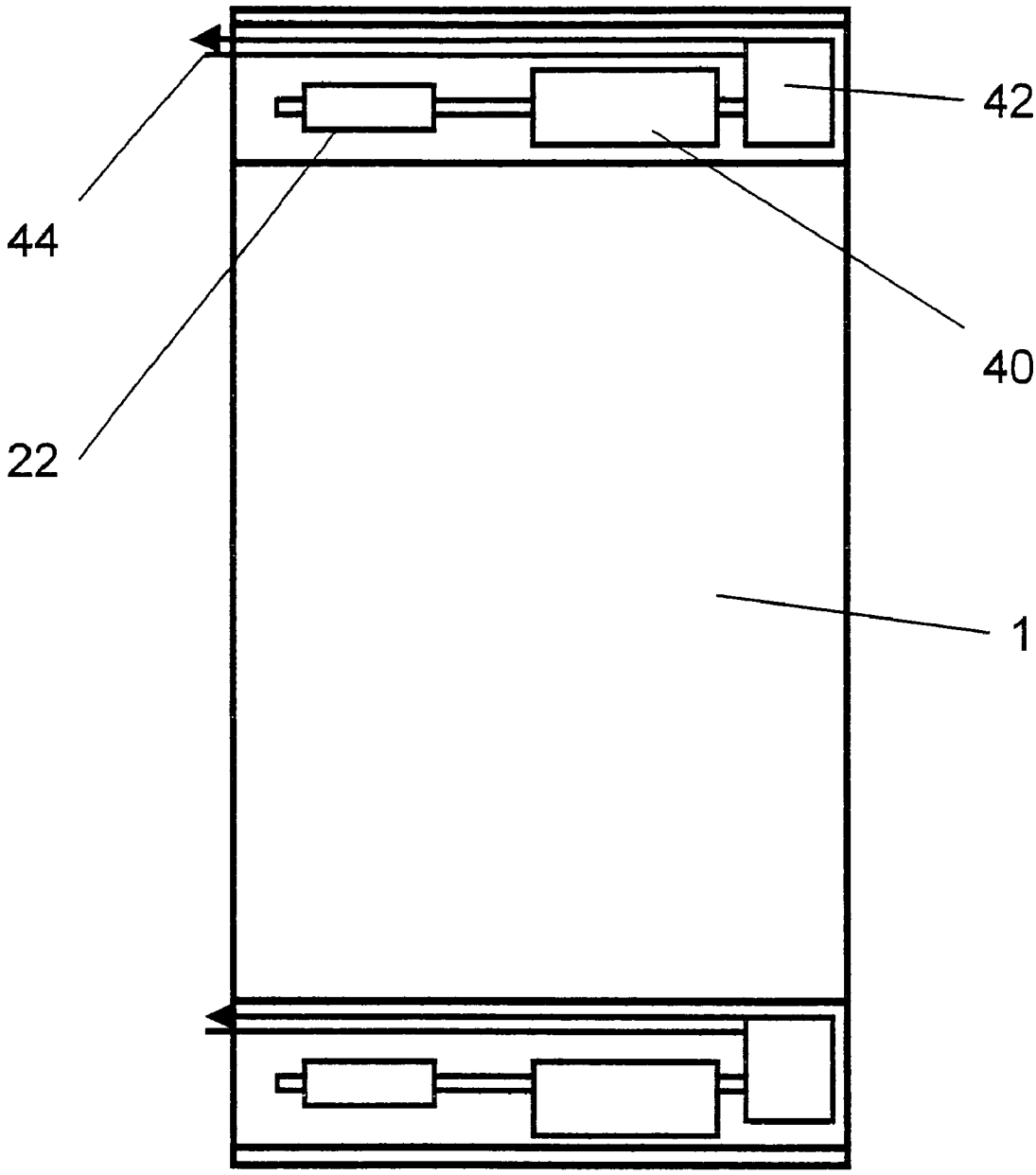
FIG. 13 shows a basic illustration of another energy supply of a wall element.
Figure 14:
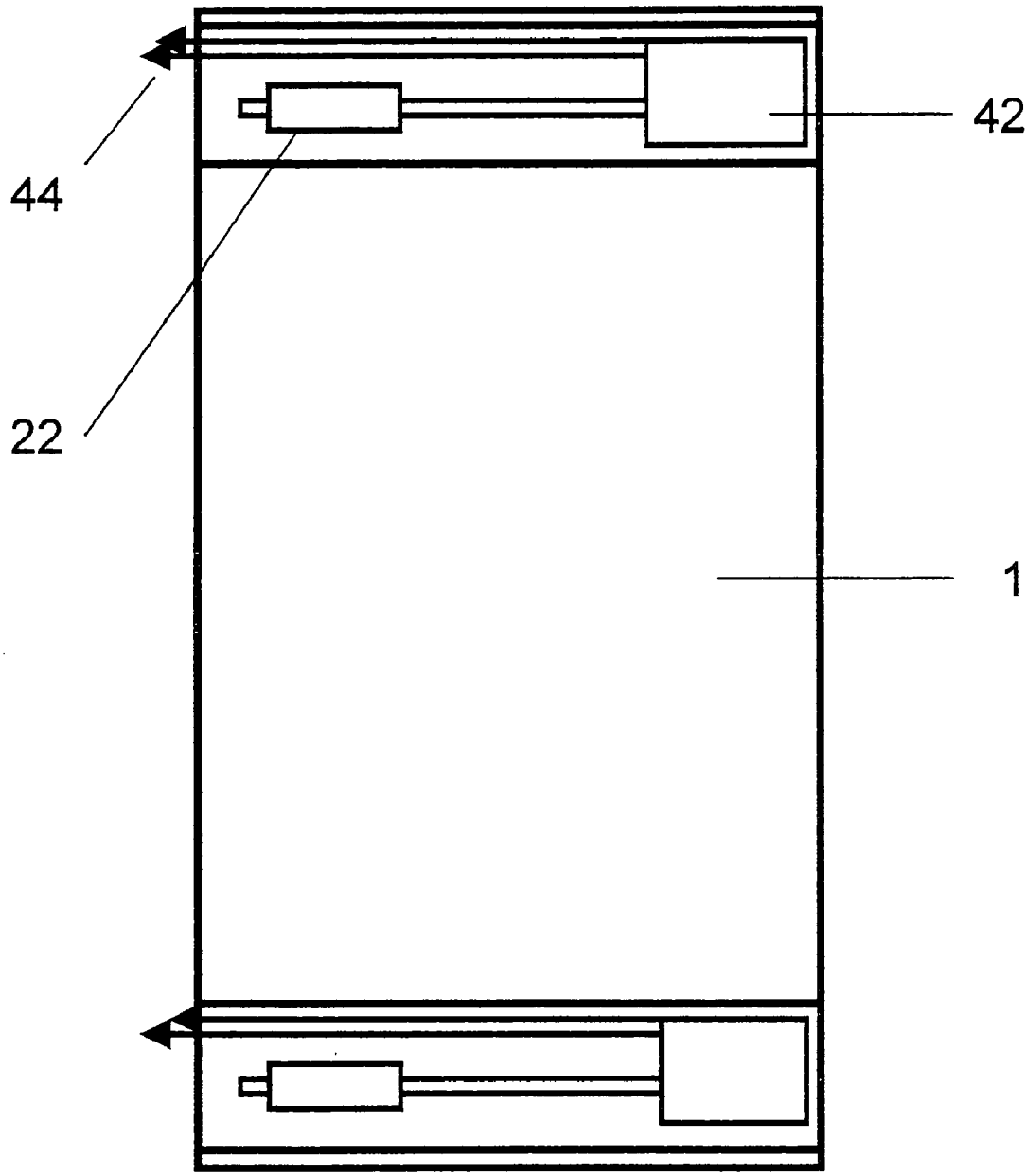
FIG. 14 shows a basic illustration of another energy supply of a wall element.

Furthermore, it is possible to supply the sealing modules with power via plug-in connections 44 at the longitudinal edges of the wall elements 1. In this case, exclusively in the event of the final positioning of all wall elements 1, a contacting through the adjoining wall elements 1 is given, because only in this case there is a connection of the plug-in contacts 44. In this case, the motor 22 can be supplied directly or with an interposed energy storage unit 40 (FIG. 13, FIG. 14).

For cases of emergency, in particular during power outages, a mechanical actuation of the sealing modules is basically always possible. However, this function may be available as the standard actuation or as an alternative variant, such as to create a semi-automatic system. For this purpose, the upper and lower sealing modules are mechanically connected, such as to achieve a synchronous actuation of both sealing strips when manipulating a crank, for example.

In addition to the horizontal termination of the wall elements 1 with the sealing strips, obviously the vertical edges, in particular at terminal elements, can be sealed by following the same principle.

Figure 15:
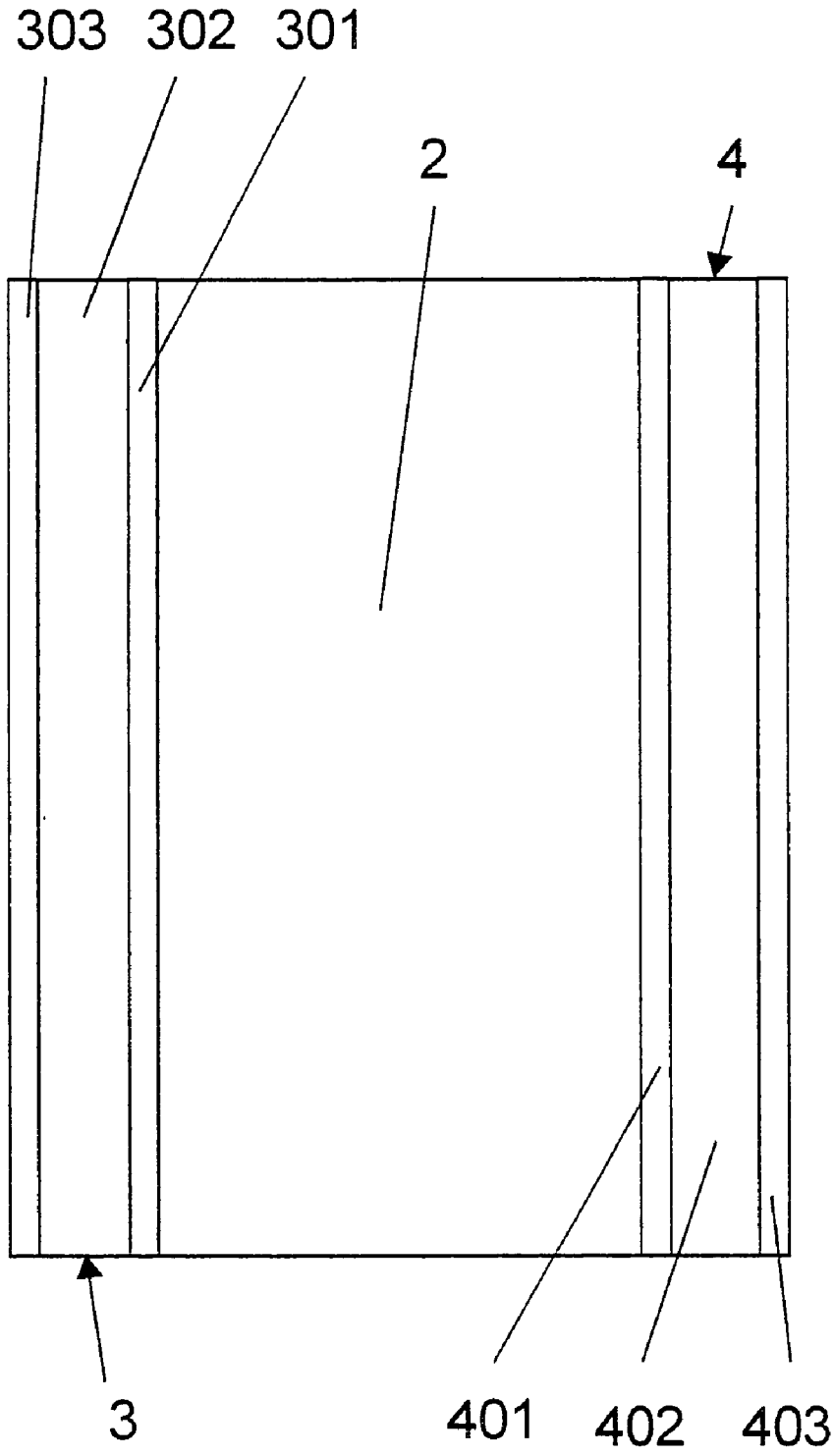
FIG. 15 shows a basic layer structure in cross-section of a panel cut to size for a wall element.

FIG. 15 illustrates the layered structure of a wall element 1. In the exemplary embodiment, the wall element 1 consists of a core 2 and exterior shells 3, 4 disposed on both sides. This results in a homologous structure. The two exterior shells 3, 4 are formed to be heavy and soundproof and are sonically separated by a preferably soft core material. The exterior shells 3, 4 and the core 2 are combined through a full bonding, in order to form a self-supporting unit.

The core 2 is made from a honeycomb structure, which in particular is formed of aluminum or paper. Alternatively, solid material such as polystyrene foam, PU-foam, mineral wool, rock wool or the like can be used to form the core 2.

Both exterior shells 3, 4 are made from several layers and consist respectively on the inside a weighting and sound insulating layer 301, 401, a middle layer 302, 402 made from honeycomb material and an exterior cover layer 303, 403. The layers are bonded to each other by means of LFI-injection.

Metallic materials, such as sheet steel or sheet aluminium, and furthermore, plastic material (PVC, PC), laminar materials (GRP), gypsum, wood, cork, etc. are suitable for the middle layers 302 and 402. The layers 302 and 402 function as the support for the visible cover layers 303 and 403. The cover layers 303 and 403 may consist of priming film, laminate, laminar materials, or melamine resin. Furthermore, veneers, textile or glass can be used to form the cover layers 303 and 403.

A particularly advantageous structure of the wall element 1 is achieved with a soft core made from PUR integral foam or melamine foam. Preferably, the mass amounts to 25 to 75 $kg/m^3$ with a thickness of 40 to 80 mm. Preferably, the weight per unit area amounts to 10 to 40 $kg/m^2$. A weighting layer 301, 401 made from bitumen is disposed on both sides and has a-thickness of about 5 to 8 mm and a weight per unit area of about 5 to 15 $kg/m^2$. The following middle layer 302, 402 is made from GRP enveloped honeycomb paper filled with PU-foam. Finally, the exterior cover layer 303, 403, which is 1 to 4 mm thick, is applied on both sides. Such a combination of materials has excellent acoustic properties and constitutes the optimum solution with regard to the parameters of sound insulation and weight per unit area, such as to reach a sound insulation factor of about 55 dB.

Figure 16:
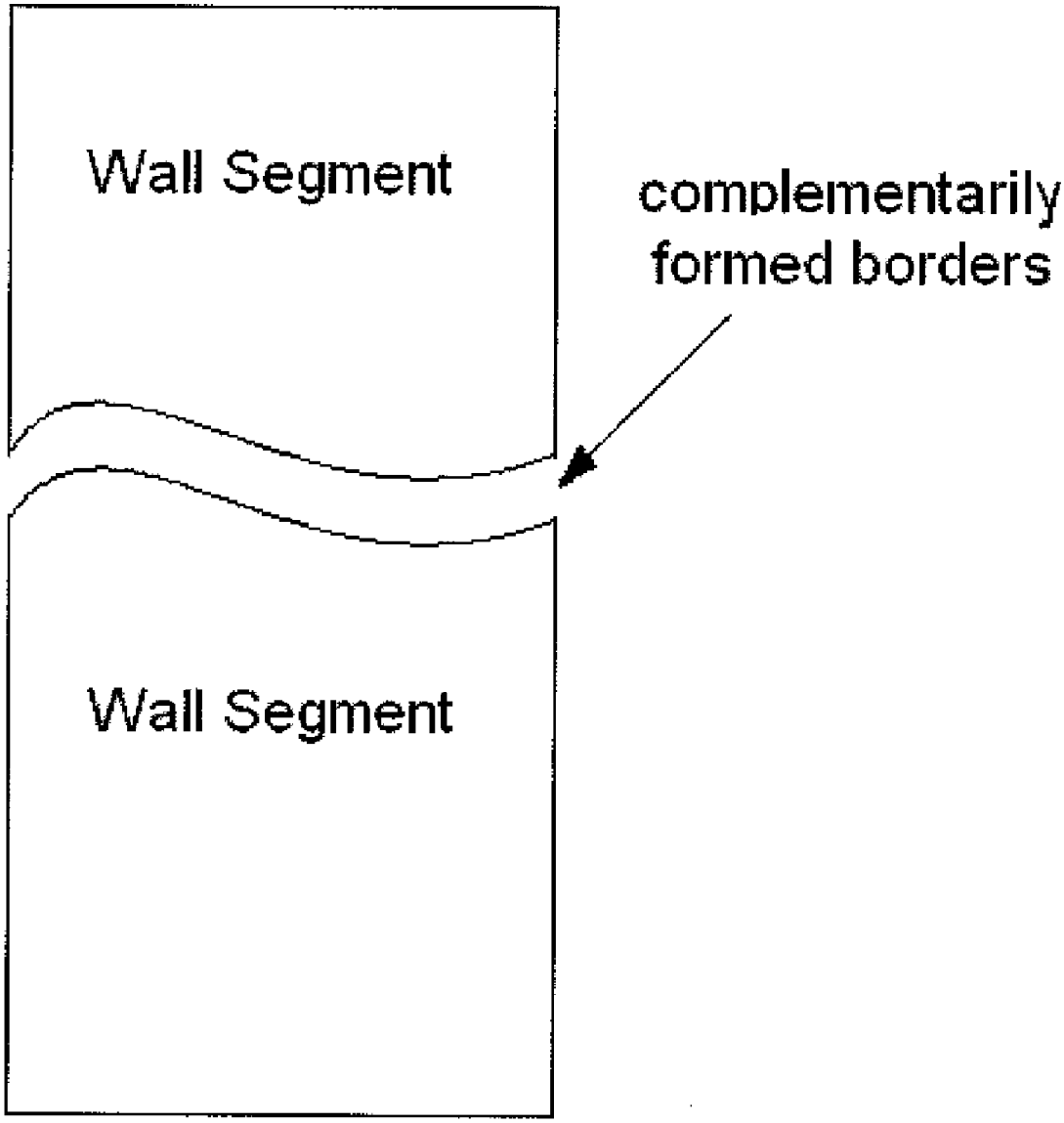
FIG. 16. shows complementarily formed border areas of the adjoining wall elements.

As shown in FIG. 16, the vertical border areas of each wall element, at least sectionally, are formed as a profile, in order to achieve a positive connection to the border areas of adjoining wall elements. For this purpose, mounting elements are disposed in particular at the vertical edges, wherein sealing profiles or molded parts are mounted, which cooperate with a complementarily formed border area of the adjoining wall element, and provide a soundproof and stable connection.

What is claimed is:

1. A mobile partitioning wall comprising:

a plurality of wall elements adapted to be displaceably suspended from one or more running rails, each of the wall elements having a pair of opposite edges;

a mounting element disposed along at least one of the edges and having a pair of interior walls provided with respective mutually facing grooves; and at least one modular structural unit laterally insertable into the mounting element and comprising a base plate for cooperating with the grooves in the mounting element, whereby the modular structural unit is supported by the mounting element, wherein the at least one modular structural unit comprises a drive and electrical contacts configured to slide on friction contacts on a running rail;

wherein adjoining wall elements have complementarily cooperating sealing profiles.

2. The mobile partitioning wall of claim 1, wherein the at least one modular structural unit comprises at least one of sealing mechanisms, sealing strips, coupling elements, lifting members, resetting members, running roller holders, drive elements and energy supply units,

3. The mobile partitioning wall of claim 1, wherein at least one of said modular structural unit comprises a displaceable sealing strip.

4. The mobile partitioning wall of claim 1, wherein the sealing strip is displaceable between an extended position beyond the mounting element and a retracted position within the mounting element.

5. The mobile partitioning wall claim 1, wherein said modular structural unit comprises a drive coupled to a sealing strip by a spindle unit.

6. The mobile partitioning wall of claim 5, wherein the drive and the spindle unit are disposed on top of each other.

7. The mobile partitioning wall of claim 5, wherein the drive and the spindle unit are disposed one behind the other.

8. The mobile partitioning wall of claim 1, wherein the modular structural unit comprises a drive coupled to a sealing strip by articulated scissors.

9. The mobile partitioning wall of claim 1, wherein the modular structural unit comprises a drive coupled to a sealing strip by a cable pull unit.

10. The mobile partitioning wall of claim 1, wherein the modular structural unit comprises a drive and an energy storage unit for supplying energy to the drive.

11. The mobile partitioning wall of claim 1, wherein the mounting element is disposed in a recess in the wall elements.

12. The mobile partitioning wall of claim 1, wherein the mounting element is surface-mounted on the wall elements.

13. The mobile partitioning wall of claim 1, wherein the mounting element is fastened on the at least one of the edges by bonding.

14. The mobile partitioning wall of claim 11, wherein the mounting element is fastened or positively disposed in the recess.

15. The mobile partitioning wall of claim 1, wherein the mounting element has one of an H-shape and a U-shape.

16. The mobile partitioning wall of claim 1, wherein a plurality of mounting elements are provided, each of which is formed on one of the wall elements.

17. The mobile partitioning wall of claim 16, wherein the modular structural unit further comprises a molded sealing part formed on horizontally adjoining mounting elements.

18. The mobile partitioning wall of claim 1, wherein the mounting element is directly disposed on the at least one of the edges.

19. A mobile partitioning wall module, comprising:

a plurality of wall elements adapted to be displaceably suspended from one or more running rails, each of the wall elements having peripheral edges;

a plurality of mounting elements each adapted to be disposed along at least one of the peripheral edges and having a pair of interior walls provided with respective mutually facing grooves; and a plurality of modular structural units each insertable into at least one of the mounting elements and comprising a base plate cooperating with the grooves in the mounting element, wherein each of the plural modular structural unit comprises a drive and electrical contacts configured to slide on friction contacts on a running rail;

whereby the mounting elements are capable of mounting the modular structural units onto the wall elements.

20. The mobile partitioning wall modules of claim 19, wherein the modular structural units comprise at least one of sealing mechanisms, sealing strips, coupling elements, lifting members, resetting members, running roller holders, drive elements and energy supply units.

21. A mobile partitioning wall comprising:

a plurality of wall elements displaceably suspended from one or more running rails having upper and lower sides, each of the wall elements comprising at least one sealing strip disposed on at least one of the upper and lower sides and being capable of moving in and out by one of a manually-driven drive unit and a motor-driven drive unit;

mounting elements disposed one of horizontally and vertically at edge sides of the respective wall elements; and modular structural units laterally insertable into the mounting elements and disposed on at least one base plate, wherein the modular structural units comprises a drive and electrical contacts configured to slide on friction contacts on a running rail;

wherein the mounting elements are one of disposed in recesses of the wall elements and surface-mounted at the wall elements; and wherein the base plate positively cooperates with grooves formed in lateral walls of the mounting elements.

22. The mobile partitioning wall of claim 21, wherein said modular structural units comprise an operating modular structural unit to operate said at least one sealing strip in and out of sealing position.

23. The mobile partitioning wall of claim 21, wherein said mounting elements are disposed in the recesses of the wall elements.

* * * * *